United States Patent [19]

Foley et al.

[11] Patent Number: 4,806,985

[45] Date of Patent: Feb. 21, 1989

[54] STRIPPER FINGERS

[75] Inventors: Geoffrey M. T. Foley, Fairport; Richard L. Schank, Pittsford; Kenneth A. Kemp, Walworth, all of N.Y.

[73] Assignee: Xerox Corporation, Stamford, Conn.

[21] Appl. No.: 31,125

[22] Filed: Apr. 2, 1987

Related U.S. Application Data

[63] Continuation-in-part of Ser. No. 884,578, Jul. 11, 1986, abandoned.

[51] Int. Cl.[4] ..... G03G 15/00

[52] U.S. Cl. ..... 355/3 SH; 271/311; 271/900; 355/3 R

[58] Field of Search ..... 271/307, 308, 311, 900, 271/312, 313, 208; 355/3 R, 3 SH, 3 TR, 14 SH; 361/214, 219, 220

[56] References Cited

U.S. PATENT DOCUMENTS

| | | | |
|---|---|---|---|
| 3,132,065 | 5/1964 | Barsy et al. | 361/220 X |
| 3,450,402 | 6/1969 | Weiler | 271/308 |
| 3,533,835 | 10/1970 | Hagenbach et al. | 430/111 |
| 3,572,499 | 3/1971 | Mondano | 361/220 X |
| 3,578,859 | 5/1971 | Stillings | 355/3 R |
| 3,804,401 | 4/1974 | Stange | 271/313 |
| 3,837,640 | 9/1974 | Norton et al. | 271/313 |
| 3,885,786 | 5/1975 | Schmalzbauer | 271/311 |
| 3,891,206 | 6/1975 | Baron | 271/313 |
| 3,948,507 | 4/1976 | Stange | 271/308 |
| 3,992,000 | 11/1976 | Martin | 271/311 |
| 4,060,320 | 11/1977 | Doi et al. | 355/3 R |
| 4,072,307 | 2/1978 | Knieser | 271/313 |
| 4,223,993 | 9/1980 | Tsuda et al. | 355/3 R |
| 4,252,310 | 2/1981 | Kono et al. | 271/900 |
| 4,387,981 | 6/1983 | Cormier | 355/3 SH |
| 4,439,509 | 3/1984 | Schank | 430/132 |
| 4,511,238 | 4/1985 | Hori | 355/3 SH |
| 4,565,760 | 1/1986 | Schank | 430/66 |
| 4,577,256 | 3/1986 | Breidegam | 361/220 |
| 4,595,602 | 6/1986 | Schank | 427/76 |

FOREIGN PATENT DOCUMENTS

| | | | |
|---|---|---|---|
| 0116375 | 7/1982 | Japan | 355/3 SH |
| 0051863 | 3/1985 | Japan | 355/3 SH |
| 1387686 | 3/1975 | United Kingdom . | |

*Primary Examiner*—A. T. Grimley
*Assistant Examiner*—John G. Smith
*Attorney, Agent, or Firm*—Peter H. Kondo

[57] ABSTRACT

A sheet stripping device for electrostatographic systems includes a frame, a member having movable surface for conveying a receiving sheet, and a sheet stripping element for separating the receiving sheet from the movable surface, the sheet stripping element including a stripping element having a leading edge adapted to contact the movable surface and strip the sheet from the movable surface, the leading edge coated with a material including an electrically conductive material comprising a film forming polymer and an electrically conductive additive. The leading edge may include a thermally resistant polymer of cross-linked siloxane-silica hybrid material, a polyimide or a poly(amide-imide). The sheet stripping means may be prepared by coating the leading edges of preformed stripping elements.

8 Claims, 1 Drawing Sheet

STRIPPER FINGERS

BACKGROUND OF THE INVENTION

The present application is a continuation-in-part of U.S. Ser. No. 884,578 filed July 11, 1986, entitled Stripper Fingers, now abandoned. The subject matter of the aforementioned copending application is incorporated by reference herein in its entirety.

This invention relates in general to an electrostatographic imaging system, and more specifically, to stripper fingers and a process for using the stripper fingers in an electrostatographic imaging system.

The formation and development of electrostatic latent images utilizing electrostatographic imaging members is well known. One of the most widely used processes being xerography as described by Carlson in U.S. Pat. No. 2,297,691. In this process, an electrostatic latent image formed on an electrophotographic imaging member is developed by applying electroscopic toner particles thereto to form a visible toner image corresponding to the electrostatic latent image. Development may be effected by numerous known techniques including cascade development, powder cloud development, magnetic brush development, liquid development and the like. The toner image deposited on the imaging member is normally transferred to a receiving member such as paper and the transferred toner image is fused by contacting the receiving member against the heated surface of a fuser roll.

When toner images are transferred from an imaging member surface of an electrostatic imaging system to a receiving member, usually in the form of a cut sheet, the sheet tends to adhere to the imaging surface. Similarly, sheets bearing an electrostatographic toner image tend to adhere to the surface of fuser rolls during fusing. Removal of the sheet from the imaging surface or fuser roll is facilitated by devices referred to in the electrostatographic imaging art as stripper fingers. These stripper fingers are normally inserted between the receiving sheet and the imaging member or fuser roll surface.

Metal stripper fingers have been utilized to strip the sheet from the imaging member or fuser roll surface. Due to manufacturing defects associated with metal stripping fingers, the stripper fingers occasionally have sharp edges or burrs which tend to abrade the imaging member or fuser roll surface. Such abrasion changes, for example, the electrical properties of an imaging member surface, particularly when the imaging member surface comprises a photoconductive imaging member. As a result of the relative hardness of the materials, metal stripper fingers that have been polished to remove sharp edges and burrs are still abrasive when contacted against photoreceptors which are cycled many thousands of cycles. Abrasion by stripper fingers can wear away critical photoreceptor layers such as the photogenerator layer to reduce photosensitivity in the areas abraded. In other words, loss of most of the thickness of a photogenerator layer underlying a stripper finger due to abrasion reduces the sensitivity of the photoreceptor. Localized alteration of photosensitivity due to abrasion of the photogenerator layer results in dark bands appearing on the receiving sheets. Total abrading away of the photogenerator layer eliminates photosensitivity, also resulting in the formation of a dark band on the receiving sheets. Abrasion can also initiate local crystallization or local reduction in dielectric thickness of photoreceptors. Copy quality defects will inevitably ensue. Abrasion of fuser rolls can cause surface roughness which adversely affects the abhesive properties of the fuser rolls and can cause undesirable transfer of toner from the receiving sheet to the fuser rolls.

The electrical properties of overcoated photoreceptors are also adversely affected by rapid abrasion of the areas of the overcoating contacted by the stripper fingers. Photoreceptors having a non-uniform overcoating due to stripper finger abrasion exhibit non-uniform electrical properties when measured across the imaging surface.

Metallic stripper fingers may be coated with polymers to limit abrasion but many polymers have different triboelectric properties than the triboelectric properties of the imaging surface so that triboelectric charging occurs where the stripper fingers contact the imaging member surface. This triboelectric charging imparts an electrical charge which is different from the charge at other locations on the imaging member surface. This may be manifested, for example, by a phenomenon referred to as background cycle up for imaging surfaces comprising, for example, a selenium alloy photoreceptor. The polymer coating on the stripper fingers tends to impart a negative charge in the areas in which the fingers contact the imaging member surface. Injected charges cause increased cycle up of the imaging potential in background regions, that is visible as dark bands on the receiving sheet.

PRIOR ART STATEMENT

U.S. Pat. No. 3,450,402 to Weiler, issued June 17, 1969—A sheet stripper is disclosed comprising a plurality of wedge-shaped fingers. The fingers may be made of any suitable material such as plastic, steel or other metal. The portion of the finger that contacts the drum surface should be covered with a substantially softer material than the photoconductive layer. One such material mentioned is tetrafluoroethylene resin (Teflon).

U.S. Pat. No. 3,885,786 to Schmalzbauer, issued May 27, 1975—A pivotable stripper is disclosed comprising an elongated stripper finger made from hardened tool steel. Prior art is also described in which fingers are made out of plastic materials or are plastic coated.

U.S. Pat. No. 3,891,206 to Bar-On, issued June 24, 1975—A sheet stripper is disclosed which is preferably constructed of a single piece of rigid plastic material having a thin layer of polytrifluoroethylene coated thereon.

U.S. Pat. No. 3,578,859 to Stillings, issued May 18, 1971—A sheet stripper is disclosed comprising a relatively thin material having nonstick or adhesive properties so that the finger will ride freely on the drum surface in nonfrictional contact therewith.

U.S. Pat. No. 3,837,640 to Norton et al, issued Sept. 24, 1974—A sheet stripper is disclosed which rides on a cushion of air. The stripper finger may be made out of any suitable material such as, metal, ceramic or mixtures thereof. A preferred material is Fotoceram. Prior art is also described in which fingers are made out of plastic materials or are plastic coated.

U.S. Pat. No. 4,072,307 to Knieser, issued Feb. 7, 1986—A sheet stripper is disclosed comprising a finger which is continuously maintained spaced above an imaging area by cantilevering the stripper finger from a bearing portion riding on an edge area. The stripper system may be formed from a solid block of metal, or hard and/or reinforced plastic. The bearing portion may have a Teflon coating or other suitable low friction surface material. Prior art is also described in which fingers comprise a bearing surface in sliding, drum riding direct engagement with the imaging surface and hold a sharp leading edge against, or slightly raised above, the imaging surface.

U.S. Pat. No. 4,565,602 to Schank, issued June 19, 1986—Overcoated electrophotographic imaging members are disclosed in which the overcoating is prepared from a cross-linkable siloxanol-colloidal silica hybrid material and a hydrolyzed ammonium salt of an alkoxy silane.

U.S. Pat. No. 4,439,509 to Schank, issued Mar. 27, 1984—Overcoated electrophotographic imaging members are disclosed in which the overcoating comprises a cross-linked siloxanol-colloidal silica hybrid material.

U.S. Pat. No. 4,565,760 to Schank, issued Jan. 21, 1986—Overcoated electrophotographic imaging members are disclosed in which the overcoating is prepared from a dispersion of colloidal silica and a hydroxylated silisesquixone in an alcoholic medium.

U.S. Pat. No. 3,533,835 to Hagenbach et al, issued Oct. 13, 1986 —Electrophotographic developer mixtures containing toner particle and carrier beads are disclosed in which at least the outer surface of the carrier beads comprise a matrix material containing electrical conductive particles.

U.S. Pat. No. 3,992,000 to Martin, issued Nov. 16, 1976—A sheet stripper is disclosed having spaced apart bearing surfaces. The bearing materials include silver, chromium alloy, nickel, an alloy of copper lead and zinc, and tungsten carbide.

U.S. Pat. No. 3,948,507 to Stange, issued Apr. 6, 1976—A sheet stripper is disclosed which is movable into and out of contact with a moving support surface such as a photoreceptor.

U.K. Patent Specification No. 1 387 686 to Ricoh, published Mar. 19, 1975—Sheet strippers are disclosed that are made of a thin sheet of a metal or from a synthetic resinous material.

U.S. Pat. No. 3,804,401 to Stange, issued Apr. 16, 1974—A sheet stripper is disclosed which rides on a cushion of air so as to not contact the drum surface during stripping. The stripper may be made of any suitable material such as Bakelite aluminum with anodized hardcoating or ceramic, or mixture thereof.

While electrostatographic imaging devices containing the above-described known stripper fingers are suitable for their intended purposes, there continues to be a need for the development of an improved stripper finger and process for using the stripper finger which extends imaging surface and fuser roll surface life of copiers, duplicators, printers and the like.

SUMMARY OF THE INVENTION

It is therefore an object of the present invention to provide an improved stripper finger.

It is another object of the present invention, to provide improved processes for removing paper from a moving surface with a stripper finger.

It is yet another object of the present invention to provide a simpler, more rapid, more economical and extended life process for removing paper from a moving surface with a stripper finger.

It is another object of the present invention, to provide a coated stripper finger that may easily be prepared at the location of a customer's machine.

It is another object of the present invention, to provide a stripper finger that may readily be repaired at the location of a customer's machine.

It is a further object of the present invention, to provide a stripper finger that is simple in design and construction and inexpensive to fabricate.

It is still another object of the present invention, to provide a stripper finger which has the mechanical properties of a metallic finger in terms of flexure and the like and the low abrasion characteristics of a polymeric finger.

It is another object of the present invention, to provide a stripper finger that minimizes the electrical properties of photoreceptors thereby minimizing impact on copy quality.

These and other objects of the present invention are accomplished by providing an electrostatographic imaging system comprising a frame, a member having movable surface adapted to receive a receiving sheet, a sheet stripping means for separating the receiving sheet from the moving surface, the sheet stripping means comprising a support element and a stripping element, the stripping element having a leading edge adapted to contact the movable surface and strip the sheet from the movable surface, the leading edge comprising an electrically conductive material comprising a film forming polymer and an electrically conductive additive.

These and other objects of the present invention may also be accomplished by providing an electrostatographic imaging system comprising a frame, a member having movable surface adapted to receive a receiving sheet, a sheet stripping means for separating the receiving sheet from the moving surface, the sheet stripping means comprising a support element and a stripping element, the stripping element having a leading edge adapted to contact the movable surface and strip the sheet from the movable surface, the leading edge comprising a thermally resistant polymer selected from the group consisting of cross-linked siloxane-silica hybrid material, a polyimide and a poly(amide-imide).

The sheet stripping means of this invention may be prepared by coating the leading edges of preformed stripping elements.

BRIEF DESCRIPTION OF THE DRAWING

Other aspects of the present invention will become apparent in view of the following description with reference to accompanying drawings.

DETAILED DESCRIPTION

Figure 1:
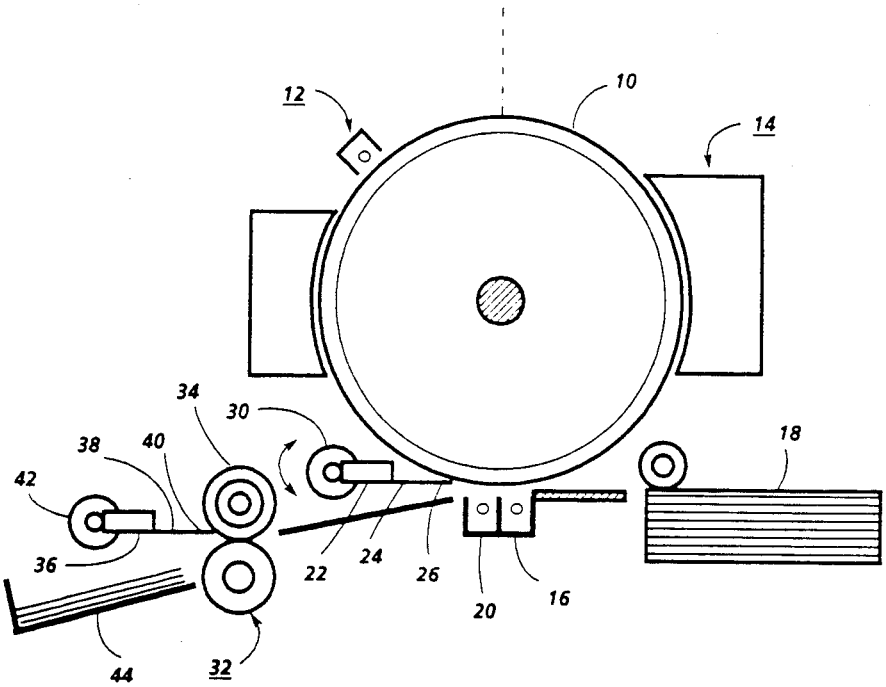
FIG. 1 shows a schematic elevational view depicting an electrostatographic imaging system.

Inasmuch as the art pertaining to stripper fingers in electrostatographic imaging systems is well known, the various processing station employed in the electrostatographic imaging system illustrated in the drawings will be described only briefly.

Referring to FIG. 1, an electrostatographic imaging system is schematically illustrated. As in all electrostatic systems such as a xerographic machine of the type illustrated, a light image of a document to be reproduced is projected onto the uniformly charged surface of a xerographic photoreceptor to form an electrostatic latent image thereon. Thereafter, the latent image is developed with an oppositely charged developing material to form a xerographic toner or powder image, corresponding to the latent image on the plate surface. The toner image is then electrostatically transferred from the photoreceptor to a receiving member. The receiving member is subsequently removed from the photoreceptor and the powder image is fused to the receiving member by a heated fuser roll whereby the powder image is caused permanently to adhere to the support surface. The receiving member bearing the fused toner image is thereafter removed from the fuser roll.

In the illustrated machine, an original to be copied is placed upon a conventional transparent support platen above (not shown) an illumination assembly (not shown) and image rays are projected by means of an optical system (not shown) for exposing the photosensitive surface of a xerographic plate in the form of a drum 10. The drum 10 is mounted upon the frame of the machine (not shown) and is adapted to rotate in the direction of the arrow at a constant rate. During this movement of the drum 10, it passes a charging station 12 where a uniform electrostatic charge is applied to the surface of drum 10. Next at an exposure station (not shown) exposure of the drum surface to the light image discharges the xerographic drum 10 in the areas struck by light to form an electrostatic latent image corresponding to the light image projected from the original. As drum 10 continues its movement, the electrostatic image passes through a developing station 14 which deposits developing material to the upper part of drum 10 to develop the electrostatic image to form powder images. The developed electrostatic latent image is transported by drum 10 to a transfer station 16 whereat receiving sheet 18 is moved at a speed in synchronism with moving drum 10 in order to accomplish transfer of the power image to receiving sheet 18. There is provided adjacent transfer station 16 a sheet detack station 20 adapted to reduce the electrostatic adhesion of receiving sheet 18 to the surface of drum 10. Receiving sheet 18 is stripped from drum 10 by a sheet stripping means comprising a support element 22 and a stripping element or finger 24. Each finger 24 has a leading edge 26 adapted to contact the moving surface of drum 10 at a scraping angle and strip sheet 18 from the moving surface. The leading edge 26 is normally maintained in contact with drum 10 during xerographic cycling but is rotated away from the surface of drum 10 by rotary solenoid 30 when the machine is not being used to make copies. The stripped sheet 18 is conveyed to a fuser apparatus generally indicated by the reference numeral 32 whereat the transferred xerographic powder image on the sheet 18 is permanently affixed thereto by contact with a rotating heated fuser roll 34. After fusing, sheet 18 is stripped from fuser roll 34 by a sheet stripping means comprising a support element 36 and a stripping elements or fingers 38. Each finger 38 has a leading edge 40 adapted to contact the moving surface of fuser roll 34 at a scraping angle and strip sheet 18 from the moving surface. The leading edge 40 is normally maintained in contact with fuser roll 34 during xerographic cycling but is rotated away from the surface of fuser roll 34 by rotary solenoid 42 when the machine is not being used to make copies. The preferred scraping angle employed for finger 24 or finger 38 is approximately tangential to the surface of drum 10 or roll 34, respectively although other angles may be used depending upon factors such as the beam strength of the receiving member, the arc of the moving surface, the distance the leading edge of the stripper finger extends relative to the point of tangency at the drum surface, and the like. The finished copy is discharged from the apparatus into a collection bin 44.

Suitable drive means are arranged to drive the drum 10 in conjunction with timed exposure of an original to be copied, to effect application of toner material at developing station 14, to separate the feed sheets of paper, to transport the same across the transfer station 16 and to convey the sheet of paper through the fuser apparatus 32 in timed sequence to produce copies of the original. It is believed that the foregoing description is sufficient for the purposes of this application to show the general operation of an electrostatic copier using an illumination system constructed in accordance with the invention. For further details concerning the specific construction of a typical electrostatic copier, reference is made to U.S. Pat. No. 3,301,126 filed Sept. 30, 1964 in the name of Osborne et al.

Figure 2:
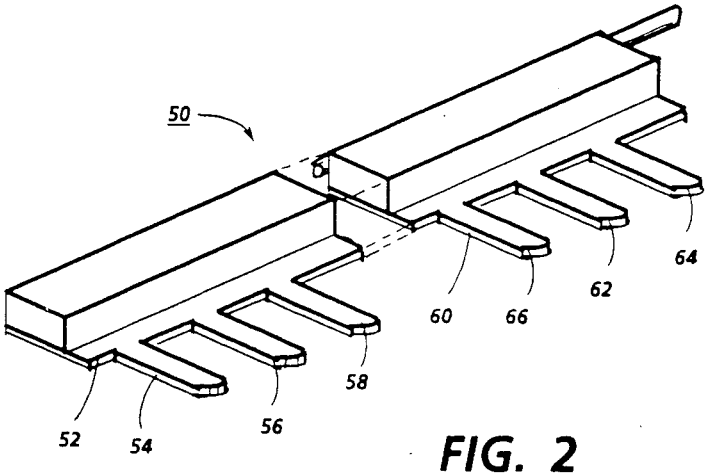
FIG. 2 shows a schematic isometric view depicting a sheet stripping means comprising a support element and a stripping element.

In FIG. 2 a sheet stripping means 50 is shown comprising a support element 52 and stripping elements or fingers 54, 56, 58, 60, 62, and 64. Each finger has a leading edge adapted to contact the moving surface of a xerographic drum (not shown) and strip a receiving sheet from the moving surface. Finger 60 is shown with a coated leading edge 66. The coating on leading edge 66 comprises an electrically conductive material comprising a film forming polymer and an electrically conductive additive if the sheet stripping means is employed to strip receiving sheets from photoreceptors or fuser rolls or comprises a thermally resistant polymer selected from the group consisting of cross-linked siloxane-silica hybrid, a polyimide, and a poly(amide-imide) if the sheet stripping means is employed to strip receiving sheets from fuser rolls only.

The electrically conductive composition employed on the stripper fingers of this invention comprises film forming polymer and an electrically conductive additive. Any suitable film forming polymer may be utilized. The film forming polymer should be abrasion resistant and preferably has sufficient hardness to resist scratching by a sharpened 4H or harder pencil. When the composition is applied to an electrically conductive supporting substrate, the polymer coating composition should wet and adhere to the supporting substrate to ensure sufficient leaking off of electrical charge to ground. The stripper fingers of this invention may, if desired, comprise an electrically conductive polymer only in the region where the stripper finger contacts the moving surface from which the receiving sheet is to be removed. Adhesion to the substrate generally requires wetting of the substrate by the coating composition. In some instances a primer coating may be used to enhance wetting of the substrate and subsequent adhesion of the polymer coating. Any suitable film forming primer coating may be employed. Typical film forming primer coatings include polyacrylics, polyesters, polyvinyl alcohol, polymethylmethacrylate and polyurethanes, compatible blends thereof and the like. In the case of certain polymer compositions such as the crosslinkable siloxanol-colloidal silica hybrid material, described in greater detail hereinbelow, such primers may be desirable when the coatings are applied to certain specific substrates such as stainless steel. Many times such primer use decisions are based on experimental trials. Typical film forming primers used with the siloxanol-colloidal silica hybrid composition include the foregoing primer materials as well as materials such as modified organosiloxane compositions known as coupling agents. Examples of organosiloxane coupling agents include, for example, 3-aminopropyltriethoxysilane, trimethoxysilylpropyldiethylenetriamine, 2-(diphenylphosphino)ethyltriethoxysilane, vinyltris(methylethylketoximine)silane, and the like.

Primer coatings are generally submicron in thickness and consequently, in most instances, do not require a conductive additive when used on an electrically grounding substrate. However, a conductive additive may be added to the primer when desired. Typical conductive additive materials listed in the ensuing text may be employed if compatible with the primer being used. The maximum amount of conductive additive incorporated into the primer should not exceed the amount which would adversely affect the integrity of the final solidified primer mixture or other mechanical properties of the primer film. The conductive additive material may be dissolved, dispersed or suspended in the primer. The primer coating composition may be applied by any suitable technique. Typical coating techniques include spraying, dipping, brushing and the like. If desired, the primer may be applied as a powder, a dispersion, a solution, emulsion, hot melt or the like. When applied as a solution, any suitable solvent may be employed. Solvents having relatively low boiling points are preferred because less energy and time is required to remove the solvent subsequent to application of the primer to the substrate.

If the electrically conductive additive material is in particulate form, the particles should preferably have a size smaller than the thickness of the primer coating composition after the primer coating is solidifed by curing or drying. Generally, the maximum average particle size should preferably be less than about 15 micrometers to minimize the amount of conductive material necessary to render the final primer coating electrically conductive, to facilitate mixing with the primer material and to provide a smooth outer surface on the solidifed primer layer.

Instead of applying the coating composition of this invention to a substrate or primary layer as a coating, the electrically conductive material may be preformed into a film or another suitable preformed shape and thereafter laminated, cemented, welded, molded, and the like to secure the preformed electrically conductive polymer composition to a preformed stripper finger.

Typical film forming polymers having a low coefficient of friction include natural resins such as caoutchouc, colophony, copal, dammar, jalap, and storax; and synthetic resins including polyolefins such as polyethylene, polypropylene, chlorinated polyethylene, and chlorosulfonated and polyethylene; polyvinyls and polyvinylidenes such as polystyrene, polymethylstyrene, polymethylmethacrylate, polyacrylonitrile, polyvinylacetate, polyvinyl alcohol, polyvinylbutyral, polyvinylchloride, polyvinylcarbazole, polyvinylether, and polyvinylketones; fluorocarbons such as polytetrafluoroethylene, polyvinylfluoride, polyvinylidene fluoride; and polychlorotrifluoroethylene; polyamides such as polyhexamethylene and polyadipamide; polyimides; poly(amide-amides); polyesters such as polyethylene terephthalate; polyurethanes; polysulfides; polycarbonates; phenolic resins such as phenol-formaldehyde, phenol-furfural, and resorcinol formaldehyde, amino resins such a urea formaldehyde and melamine formaldehyde; epoxy resins; organosilicone resins and rubbers and the like. Polyacrylic emulsions e.g. Duro-Cryl 720, available from National Starch and Chemical Co. and cross-linkable siloxanol-colloidal silica hybrid material available from Dow Corning Co., are particularly preferred because of their ease of application to preformed stripper fingers and their abrasion resistance characteristics.

The cross-linkable siloxanol-colloidal silica hybrid material, polyimide resin or poly(amide-imide) resin with or without conductive additives may also be applied to stripper fingers for fuser rolls to achieve reduced abrasion of the fuser roll surface. The cross-linked siloxanolcolloidal sillica hybrid material, polyimide resin and poly(amide-imide) resin are thermally resistant and can readily tolerate the high operating temperatures of fuser rolls. The expression "thermally resistant" is defined herein as having a decomposition temperature of at least about 180° C.

Methods of preparing the cross-linkable siloxanol-colloidal silica hybrid material are described, for example, in U.S. Pats. Nos. 3,986,997, 4,027,073, 4,439,509, and 4,595,602 the entire disclosure of each patent being incorporated herein by reference. If desired, the method described in U.S. Pat. Nos. 3,986,997, 4,027,073, and 4,439,509, may be modified so that no acid is utilized during preparation.

Examples of cross-linkable siloxanol-colloidal silica hybrid materials that are useful in the present invention are essentially the same as those materials commercially available from Dow Corning, such as Vestar Q9-6503 and from General Electric such as SHC-1000, and SHC-1010 except that for some embodiments the cross-linkable siloxanol-colloidal silica hybrid material compositions are substantially free of ionic components such as acids, metal salts of organic and inorganic acids and the like. These cross-linkable siloxanol-colloidal silica hybrid materials have been characterized as a dispersion of colloidal silica and a partial condensate of a silanol in an alcohol-water medium.

These cross-linkable siloxanol-colloidal silica hybrid materials are believed to be prepared from trifunctional polymerizable silanes preferably having the structural formula:

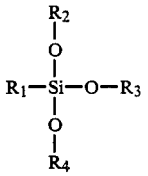

wherein $R_1$ is an alkyl or allene group having 1 to 8 carbon atoms, and $R_2$, $R_3$, and $R_4$ are independently selected from the group consisting of methyl and ethyl.

The OR groups of the trifunctional polymerizable silane are hydrolyzed with water and the hydrolyzed material is stabilized with colloidal sillica, alcohol, and a minimal amount of acid whereby the acid number of the resulting mixture is less than about 1. At least some of the alcohol may be provided from the hydrolysis of the alkoxy groups of the silane. The stabilized material is partially polymerized as a pre-polymer prior to application as a coating on a stripping member. The degree of polymerization should be sufficiently low with sufficient silicon bonded hydroxyl groups so that the organosiloxane pre-polymer may be applied in liquid form with or without a solvent to the electrophotographic imaging member. Generally, this prepolymer can be characterized as a siloxanol polymer having at least one silicon-bonded hydroxyl group per every three —SiO— units. Typical trifunctional polymerizable silanes include methyl triethoxysilane, methyl trimethoxysilane, vinyl triethoxysilane, vinyl trimethoxysilane, butyl triethoxysilane, propyl trimethoxysilane, phenyl triethoxysilane and the like. If desired, mixtures of trifunctional silanes may be employed to form the cross-linkable siloxanol-colloidal silica hybrid. Methyl trialkoxysilanes are preferred because polymerized coatings formed therefrom are more durable.

The silica component of the coating mixture is present as colloidal silica. The colloidal silica is available in aqueous dispersions in which the particle size is between about 5 and about 150 millimicrons in diameter. Colloidal silica particles having an average particle size between about 10 and about 30 millimicrons provide coatings with the greatest stability. An example of a method of preparing the cross-linkable siloxanol-colloidal silica hybrid material is described in U.S. Pats. Nos. 3,986,997, 4,027,073, and 4,439,509. The dispersion was filtered through a 1-micron filter to remove large silica particles. A stabilizer may be added to prevent any gellation or setting at room temperature.

A condensation catalyst is normally incorporated into the coating mixture containing the cross-linkable siloxanol-colloidal silica hybrid material prior to applying the coating mixture to the stripper finger substrate. If desired, the condensation catalyst may be omitted from the coating mixture. Where a condensation catalyst is employed, the amount added to the coating mixture is normally less than about 10 percent by weight based on the weight of the cross-linkable siloxanol-colloidal silica hybrid material. Selection of curing temperatures to cross-link the siloxanol-colloidal silica hybrid material depends upon the amount and type of catalyst employed as well as the thermal stability of the photoreceptor which has been overcoated. Generally, satisfactory curing may be achieved at curing temperatures between about 30° C. and about 100° C. when using a catalyst and temperatures between about 100° C. and about 140° C. when a catalyst is not employed. Curing time varies with the amount and type of catalyst employed as well as the temperature used. During curing of the cross-linkable siloxanol, i.e. partial condensate of a silanol, the residual hydroxyl groups condense to form a silsesquioxane, RSiO 3/2. When the overcoating is adequately cross-linked, it forms a hard, solid coating which is not dissolved by isopropyl alcohol. The cross-linked coating is exceptionally hard and resists scratching by a sharpened 5H or 6H pencil. Any suitable solvent or solvent mixture may be utilized to facilitate forming the desired coating film thickness. Alcohols such as methanol, ethanol, propanol, isopropanol butanol, isobutanol and the like can be employed with excellent results. The addition of solvents or diluents also seems to minimize microgel formation. If desired, solvents such as 2-methoxyethanol may be added to the coating mixture to control the evaporation rate during the coating operation.

When the stripper finger is to be employed for fuser rolls, it can be coated with the cross-linkable siloxanol-colloidal silica hybrid material free of conductive additive material or admixed with conductive additive material. The coating of cross-linkable siloxanol-colloidal silica hybrid material free of conductive additive material imparts to fuser roll stripper fingers improved mechanical properties such as abrasion resistance coupled with an ability to withstand the elevated operating temperatures characteristic of fuser rolls.

Thermoplastic polyimide resins may be represented by the general structural formula:

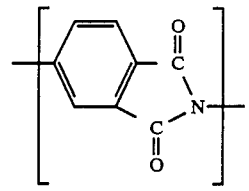

Polyimide resins are available, for example, from Amoco Chemicals Co. Thermoplastic poly(amide-imide) resins may be represented by the general structural formula:

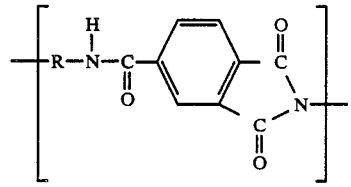

wherein R is a phenylene group. Poly(amide-imide) resins are available, for example, as AL-10 and AL-11 from Amoco Chemicals Co.

Any suitable electrically conductive additive material may be utilized in the electrically conductive composition of this invention. The electrically conductive material having a volume resistivity of less than about $10^{10}$ ity less than about $10^{10}$ ohm centimeters because the blend of the electrically conductive additive material with the matrix polymer results in a composite material having the electrical conductivity necessary to prevent undesirable triboelectric charging of photoreceptors.

Any suitable organic or inorganic conductive material having a volume resistivity of less than about $10^{10}$ ohm centimeters at about 23° C. may be employed to render the film forming polymer composition electrically conductive. Optimum results are achieved with particulate conductive materials having a volume resistivity of less than about 1 ohm centimeter at 23° C. because proportionally less of the electrically conductive material is necessary to render the mixture electrically conductive. Preferably, the conductivity of the particulate additives should be independent of ambient relative humidity conditions. Typical materials having a volume resistivity of less than about $10^{10}$ ohm centimeters at 22° C. include: ammonium salts such as trimethoxysilypropyl-N,N,N-trimethylammonium chloride quaternary salt ($(CH_3O)_3 Si(CH_2)_3N (CH_3)_3Cl$-), aurin tricarboxylic acid, indanthrone black, cyan anthrone, carbon black, graphite, calcium chloride, potassium bromide, silver nitrate, sodium chloride, lithium chloride, silver iodide, lithium bromide, caesium bromide, sodium iodide, nickel oxide, ferric oxide, antimony-tin oxide, ferrocene, nickelocene, titanocene, vinylferrocene, diferrocenylphosphine, 1,1'-ferrocene-bis-(diphenylphsophine), acetylferrocene, dibenzferrocene, dimethylaminoethyl ferrocene, methylaminoethyl ferrocene, methylaminomethyl ferrocene, ferrocenylacetonitrile, ferrocenylcarbonal, ferrocene sulfonic acid, diferrocenylmethane, diferrocenylethane, phenylferrocene, phenyl cyclopentaferrocene, benzoylferrocene, acetylferrocene, and the like and mixtures thereof. Preferred conductive additives are suitable ammonium salts of an alkoxy silane having the formula:

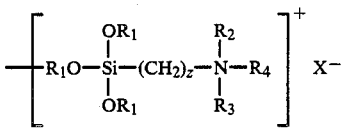

wherein $R_1$, $R_2$, and $R_3$ are independently selected from the group consisting of aliphatic and substituted aliphatic radicals having 1 to 20 carbon atoms, $R_4$ is selected from the group consisting of aliphatic radicals, substituted aliphatic radicals and the group:

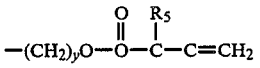

wherein y is a number from 2 to 4, and $R_5$ is hydrogen or an alkyl radical, z is a number from 1 to 5 and X is an anion. Typical aliphatic and substituted aliphatic radicals having from 1 to 4 carbon atoms include methyl, ethyl, propyl, isopropyl, butyl, pentyl, hexyl, heptyl, octyl, nonyl, decyl, pentadecyl, and the like. Typical anions include halides such as chloride, bromide, fluoride or iodide; sulfate; nitrite; nitrate; propionate; acetate; formate; and the like. Typical groups represented by the structural formula:

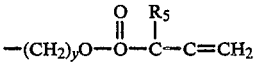

include methacryloxyethyl, acryloxyethyl, and the like.

Typical ammonium salts of an alkoxy silane include trimethoxysilylpropyl-N,N,N-trimethylammonium chloride, trimethoxysilylpropyl-N,N,N-trimethylammonium acetate, methacryloxyethyl dimethyl; [3-trimethoxysilylpropyl]ammonium chloride, N-vinylbenzyl-N-2-[trimethoxysilylpropylamino]ethyl ammonium chloride, acryloxyethyl dimethyl [3-trimethoxysilylpropyl]ammonium chloride, octadecyldimethyl [3-trimethoxysilylpropyl]ammonium chloride and the like. These ammonium salts of alkoxy silanes are hydrolyzed by diluting in suitable alcohols such as methanol or ethanol to a desired solids concentration, e.g. 10–30 percent, and then adding a slight excess of water at ambient temperature to hydrolyze the alkoxy groups attached to the silicon atom of the alkoxy silane.

Various factors affect the relative quantity of electrically conductive additive material to be incorporated into the film forming binder mixture. These factors include the electrical conductivity of the material added, the average particle size of the electrically conductive material added, and the like. Sufficient electrically conductive additive material should be utilized in the electrically conductive coating composition to impart to the mixture after drying or curing an electrical volume resistivity of less than about $10^{13}$ ohm cm to provide the necessary electrical conductivity to prevent triboelectric charging of the photoreceptor and charge accumulation on the stripper fingers. The maximum amount of conductive additive incorporated into the conductive polymer mixture should not exceed the amount of which would affect the integrity of the final solidified mixture or otherwise adversely affect the mechanical properties of the film.

The conductive additive material may be dissolved, dispersed or suspended in the film forming binder mixture. Preferably, the electrically conductive additive material is soluble in the film forming polymer for more uniform electrical properties. The dispersions or suspensions may be prepared by any suitable conventional technique. It is to be understood that the film forming material employed to form the matrix may be in any suitable form such as a hot melt, a solution, an emulsion, a liquid monomer or a dispersion. When the conductive coating composition of this invention is to be a coating, the material may be applied by conventional methods such as spraying, dipping, brushing and the like. If desired, the coating composition may be applied as a powder, a dispersion, a solution, emulsion, or hot melt. When applied as a solution, any suitable solvent may be employed. Solvents having relatively low boiling points are preferred because less energy and time is required to remove the solvent subsequent to application of the coating to the substrate. If desired, the coating may comprise conductive additive material dispersed in resin monomers which are polymerized in situ on the surface of the substrate. Any suitable coating thickness may be employed. The thickness is determined to some extent by the durability of the polymer employed and the number of cycles to be encountered.

If the electrically conductive additive material is in particulate form, the particles should have a size smaller than the thickness of the electrically conductive coating composition after the electrically conductive coating composition is solidified by curing or drying. Generally, the maximum average particle size should preferably be less than about 15 micrometers to minimize the amount of conductive material necessary to render the final mixture electrically conductive, to facilitate mixing with the film forming binder and to provide a smooth outer surface on the solidified conductive mixture that is substantially uninterrupted by portions of relatively large diameter conductive particles protruding above the outer surface of the solidified conductive forming binder mixture. Optimum surface characteristics are achieved when the conductive additives have an average particle size of less than about 0.1 micrometer to achieve a smooth outer surface with low abrasion and frictional characteristics. Typically, the conductive additive material does not migrate to and contaminate the electrophotographic imaging member surfaces and is chemically and electrically inert relative to the imaging member surfaces.

Although the entire structure of the stripper fingers of this invention may comprise electrically conductive polymeric mixtures of this invention, preformed electrically conductive stripper fingers may merely be coated with an electrically conductive polymer composition. When the electrically conductive additive materials are applied as a coating to a supporting substrate it is preferred that the coating mixture comprise an aqueous emulsion for safer handling when applied to preformed stripper fingers in the field. Also, coating compositions that cure or dry at room temperatures are preferred when the materials are applied to preformed stripper fingers in the field.

Any suitable well-known preformed stripper finger may be employed as the substrate of the stripper fingers of this invention. Stripper fingers may be rigid, flexible, constantly in contact with the photoreceptor or fuser roll surface or retractable from the fuser roll or photoreceptor surface. Typical stripper fingers are illustrated in U.S. Pat. No. 3,992,200 to Martin, U.S. Pat. No. 3,578,859 to Stillings, U.S. Pat. No. 3,450,402 to Weiler, U.S. Pat. No. 3,891,206 to Bar-On, U.S. Pat. No. 3,885,789 to Schmalzbauer, and U.S. Pat. No. 4,072,307 to Knieser. The entire disclosures of these patents are incorporated herein by reference. All of these stripper fingers have a leading edge which is inserted between the receiving sheet and a moving surface to separate the receiving sheet from the moving surface. At least the segment of the leading edge of the stripper finger that comes into contact with the moving surface should comprise an electrically conductive coating composition of film forming polymer and conductive additive material where the moving surface is an imaging surface or fuser surface, or comprise a thermally resistant polymer such as the cross-linked siloxanol-colloidal silica hybrid material coating composition described above where the moving surface is a fuser surface.

Typical preformed stripper finger substrates include flexible or rigid preformed fingers. The fingers may comprise electrically conductive materials such as metals, composite materials, and the like. Typical metals include stainless steel, copper beryllium alloys, nickel, and the like.

If desired, the preformed stripper finger supporting substrate may be insulating with suitable provisions to allow electrical grounding of the electrically conductive layer. For example, a bare electrically grounded metal wire may be secured to the outer surface of the insulating preformed stripper finger supporting substrate prior to application of a coating of the electrically conductive coating composition. When an electrically conductive layer is secured to a preformed substrate, the layer may be discontinuous so long as a sufficient quantity of the electrically conductive material is located on the preformed substrate to space the preformed substrate away from the imaging surface. Preferably, when a layer of the electrically conductive coating composition is utilized on a preformed stripper finger, the layer should have a minimum thickness of at least about 0.5 micrometer because of wear considerations.

Generally, the pressure applied by the leading edge of the stripper finger across the moving surface of a photoreceptor or fuser roll should be sufficient to effect separation of the receiving sheet from the moving surface. Excessive pressure should be avoided to minimize abrasion.

The stripper finger of this invention having an outer surface of an electrically conductive metal comprising a film forming polymer and an electrically conductive additive may be employed to strip paper from any suitable inorganic or organic photoreceptor surface. The photoreceptor may be of any suitable configuration. Typical configurations include webs, belts, flexible or rigid cylinders, and the like. Typical inorganic photoresponsive materials for photoreceptors in one or more layers include selenium, selenium alloys, such as arsenic selenium and tellurium selenium alloys, halogen doped selenium, halogen doped selenium alloys, amorphous silicon, and the like. Other typical photoresponsive materials include inorganic photoconductive materials dispersed in a film forming binder as disclosed, for example in U.S. Pat. No. 3,121,006 to Middleton et al and multilayered systems comprising a generating layer and a transport layer as disclosed, for example, in U.S. Pat. No. 4,265,990 to Stolka et al. The entire disclosures of these two patents are incorporated herein by reference.

The stripper finger of this invention having a material comprising a film forming polymer selected from the group consisting of cross-linked siloxane-silica hybrid material and polyimide may be employed to strip paper from any suitable fuser surface. Typical fuser surfaces include polytetrafluoroethylene, PFA, Viton, polysiloxane, filed polymers employed with silcone oil, and the like.

In summary, the stripper finger of this invention may comprise an uncoated electrically conductive polymer composition or a substrate coated with an electrically conductive polymer composition. The electrically conductive polymer composition may be applied applied to a preformed stripper finger during the manufacturing process or by technicians or customers in the field. The electrically conductive polymeric stripper finger coating materials are inexpensive and simple to manufacture. In other words, no mechanical properties of existing mechanical stripper fingers need be altered except for their abrasion characteristics. In addition, many of the coating materials of this invention may be utilized to repair damaged stripper fingers in the field. If desired, with some coating materials, currently used metal stripper fingers may merely be dipped in the coating liquid and hung to dry. In some cases, the coating may be cured or dried at room temperature. Drying or curing may be accelerated with heat and air from an oven or from an ordinary hot air blower. Thus, the stripper fingers that were coated at the factory or by the technician or customer at the site of the electrophotographic copier. Thus, an inexpensive, simple and effective approach is described to overcome an existing problem.

The invention will now be described in detail with reference to specific preferred embodiments thereof, it being understood that these examples are intended to be illustrative only. The invention is not intended to be limited to the materials, conditions, or process parameters recited herein. All parts and percentages are by weight unless otherwise indicated.

EXAMPLE I

An electrophotographic copier similar to that illustrated in FIG. 1 was utilized in a comparative test. The copier employed six flexible stainless steel stripper fingers similar to that illustrated in FIG. 2. These fingers has a thickness of about 0.010 inch, a width of about 1 cm, a radius of curvature of about 1 mm at the free end, and a length of about 2.5 cm extending from a continuous strip which connected the fingers. The stainless steel stripper fingers were brought into contact with a cylindrical selenium alloy photoreceptor to remove paper receiving sheets from the photoreceptor surface. The photoreceptor comprised two layers in which the upper layer comprised a selenium tellurium alloy photogenerator layer. This selenium tellurium photogenerator layer had an outer layer of tellurium oxide having a thickness of about 100 Angstroms. During xerographic cycling, the stainless steel stripper fingers abraded through the tellurium oxide layer and increased the photoreceptor sensitivity in the abraded regions due to removal of the tellurium oxide layer. After about ten imaging cycles, this local increase in photosensitivity manifested itself as unacceptable light stripes in grey or black solid areas on the paper receiving sheet copies corresponding to the circumferentially abraded regions.

EXAMPLE II

An electrophotographic copier similar to that illustrated in FIG. 1 was utilized in a comparative test. The copier employed six flexible stainless steel stripper fingers similar to that illustrated in FIG. 2. These fingers had a thickness of about 0.010 inch, a width of about 1 cm, a radius of curvature of about 1 mm at the free end, and a length of about 2.5 cm extending from a continuous strip which connected the fingers. Three adjacent stripper fingers were dip coated with an electrically conductive composition while the other three adjacent stripper fingers were left uncoated. The applied coating was an electrically conductive coating composition comprising a water based 15 percent by weight solids emulsion of polyacrylic resin (Duro Cryl 720, available from National Starch and Chemical Company) and 10 percent by weight, based on the total weight of the coating composition, of trimethoxysilypropyl-N,N,N,-trimethylammonium chloride quaternary salt ($(CH_3O)_3Si\ (CH_2)_3N^+(CH_3)_3Cl^-$). After drying at about 80° C. for about 15 minutes, the coating had a volume electrical resistivity of about $10^{12}$ ohm cm and was highly abrasion resistant. During xerographic cycling, all the stripper fingers were maintained in contact with a cylindrical selenium alloy photoreceptor having a diameter of about 3.3 cm to remove paper receiving sheets from the photoreceptor surface. The photoreceptor comprised two layers in which the upper layer comprised a selenium tellurium alloy photogenerator layer. This selenium tellurium photogenerator layer had an outer layer of tellurium oxide having a thickness of about 100 Angstroms. The copier was xerographically cycled in a conventional manner during which the photoreceptor was uniformly charged, exposed to activating light in image configuration to form an electrostatic latent image, developed to form a toner image corresponding to the latent image, and the toner image was electrostatically transferred to a paper receiving sheet. After 200 imaging cycles, excellent images with no change in copy quality were observed on the segment of the receiving sheet corresponding to the region of the photoreceptor surface contacted with the coated stripper finger whereas unacceptable light stripes in grey or black solid areas images were observed on the segment of the receiving sheet corresponding to the region of the photoreceptor surface contacted with the uncoated stripper fingers. Thus, the results of this test showed an absence of any quality defects from the region under the coated fingers and the usual defects associated with non-overcoated fingers after extended xerographic cycling.

EXAMPLE III

An electrophotographic copier similar to that illustrated in FIG. 1 was utilized in a comparative test. The copier employed six flexible stainless steel stripper fingers similar to that illustrated in FIG. 2. These fingers had a thickness of about 0.010 inch, a width of about 1 cm, a radius of curvature of about 1 mm at the free end, and a length of about 2.5 cm extending from a continuous strip which connected the fingers. Three adjacent stripper fingers were dip coated with an electrically conductive composition while the other three adjacent stripper fingers were left uncoated. The applied coating was an electrically conductive coating composition comprising cross-linkable siloxanol-colloidal silica hybrid material available from Dow Corning Company containing 10 percent by weight solids in isobutanol-/isopropanol and 10 percent by weight, based on the total weight of the coating composition, of trimethoxysilypropyl-N,N,N,-trimethylammonium chloride quaternary salt ($(CH_3O)_3Si\ (CH_2)_3N^+(CH_3)_3Cl^-$). After curing at about 80° C. for about 1 hour, the coating had a volume electrical resistivity of about $10^{12}$ ohm cm and was highly abrasion resistant. During xerographic cycling, all the stripper fingers were maintained in contact with a cylindrical selenium alloy photoreceptor having a diameter of about 3.3 cm to remove paper receiving sheets from the photoreceptor surface. The photoreceptor comprised two layers in which the upper layer comprised a selenium tellurium alloy photogenerator layer. This selenium tellurium photogenerator layer had an outer layer of tellurium oxide having a thickness of about 100 Angstroms. The copier was xerographically cycled in a conventional manner during which the photoreceptor was uniformly charged, exposed to activating light in image configuration to form an electrostatic latent image, developed to form a toner image corresponding to the latent image, and the toner image was electrostatically transferred to a paper receiving sheet. After 200 imaging cycles, excellent images with no change in copy quality were observed on the segment of the receiving sheet corresponding to the region of the photoreceptor surface contacted with the coated stripper finger whereas unacceptable light stripes in grey or black solid areas images were observed on the segment of the receiving sheet corresponding to the region of the photoreceptor surface contacted with the uncoated stripper fingers. Thus, the results of this test showed an absence of any quality defects from the region under the coated fingers and the usual defects associated with non-overcoated fingers after extended xerographyic cycling.

EXAMPLE IV

An electrophotographic copier similar to that illustrated in FIG. 1 was utilized in a comparative test. The copier employed six flexible stainless steel stripper fingers similar to that illustrated in FIG. 2. These fingers had a thickness of about 0.010 inch, a width of about 1 cm, a radius of curvature of about 1 mm at the free end, and a length of about 2.5 cm extending from a continuous strip which connected the fingers. All six stripper fingers were first dip coated with a primer solution consisting of an 80/20 by weight solution of polyester (PE-200 available from Goodyear Chemical Company) and polymethylmethacrylate (available from Polysciences Inc.) in methylene chloride solvent at 0.1 wt.% solids. The primer was air dried to form a submicron film. The primer layer was thereafter overcoated with an electrically conductive coating composition comprising cross-linkable siloxanol-colloidal silica hybrid material (available from Dow Corning Company) containing 10 percent by weight solids in isobutanol/isopropanol and 10 percent by weight, based on the total weight of the coating composition, of trimethoxysilypropyl-N,N,N,-trimethylammonium chloride chloride quaternary salt ($(CH_3O)_3Si\ (CH_2)_3N^+(CH_3)_3Cl^-$). After curing at about 80° C. for about 1 hour, the coating had a volume electrical resistivity of about $10^{12}$ ohm cm and was highly abrasion resistant. During xerographic cycling, all the stripper fingers were maintained in contact with a cylindrical selenium alloy photoreceptor having a diameter of about 3.3 cm to remove paper receiving sheets from the photoreceptor surface. The photoreceptor comprised two layers in which the upper layer comprised a selenium tellurium alloy photogenerator layer. This selenium tellurium photogenerator layer had an outer layer of tellurium oxide having a thickness of about 100 Angstroms. The copier was xerographically cycled in a conventional manner during which the photoreceptor was uniformly charged, exposed to activating light in image configuration to form an electrostatic latent image, developed to form a toner image corresponding to the latent image, and the toner image was electrostatically transferred to a paper receiving sheet. After 5000 imaging cycles, excellent images with no change in copy quality were observed on the segment of the receiving sheet corresponding to the region of the photoreceptor surface contacted with the coated stripper finger whereas unacceptable light stripes in grey or black solid areas images were observed on the segment of the receiving sheet corresponding to the region of the photoreceptor surface contacted with the uncoated stripper fingers. Thus, the results of this test showed an absence of any quality defects from the region under the coated fingers and the usual defects associated with non-overcoated fingers after extended xerographyic cycling.

Although the invention has been described with reference to specific preferred embodiments, it is not intended to be limited thereto, rather those skilled in the art will recognize that variations and modifications may be made therein which are within the spirit of the present invention and within the scope of the following claims.

What is claimed is:

1. In an electrostatographic imaging apparatus comprising a frame, a member having a movable surface adapted to receive a receiving sheet, and a sheet stripping means for separating said receiving sheet from said movable surface, said sheet stripping means comprising a support element and a stripping element, said stripping element having a leading edge adapted to contact said movable surface and strip said sheet from said movable surface, said leading edge comprising a metal substrate, a film forming primer coating on said substrate, and an electrically conductive coating on said film forming primer coating, said electrically conductive coating having a volume resistivity of less than about $10^{13}$ ohm centimeters, a thickness of at least about 0.5 micrometer, and comprising a film forming polymer and an electrically conductive additive, said film forming polymer selected from the group consisting of a cross-linked siloxanol-colloidal silica hybrid material, a polyimide and poly(amide-imide), and said electrically conductive additive having a volume resistivity of less than about $10^{10}$ ohm centimeters and an average particle size of less than about 0.1 micrometer.

2. In an electrostatographic imaging apparatus according to claim 1, wherein said film forming primer coating is submicron in thickness.

3. In an electrostatographic imaging apparatus according to claim 1, wherein said film forming primer coating contains an electrically conductive additive.

4. In an electrostatographic imaging apparatus according to claim 1, wherein said cross-linked siloxanol-colloidal silica hybrid material has a decomposition temperature greater than about 180° C.

5. In an electrostatographic imaging apparatus according to claim 1, wherein said leading edge comprises a film forming primer coating between said substrate and said electrically conductive coating on said film forming primer coating, said film forming primer coating comprising an organosiloxane coupling agent.

6. In an electrostatographic imaging apparatus according to claim 1, wherein said film forming polymer is a polyimide having a decomposition temperature greater than about 180° C.

7. In an electrostatographic imaging apparatus according to claim 1, wherein said film forming polymer is a poly(amide-imide) having a decomposition temperature greater than about 180° C.

8. In an electrostatographic imaging apparatus according to claim 1, wherein said said movable surface is a photoreceptor surface.

* * * * *